US012351961B2

(12) United States Patent
Bagley et al.

(10) Patent No.: US 12,351,961 B2
(45) Date of Patent: Jul. 8, 2025

(54) SEWING FRAME WITH WORKSPACE EDGE WARNING SYSTEM

(71) Applicant: Gracewood Management, Inc., West Valley City, UT (US)

(72) Inventors: Jim Matthews Bagley, West Valley City, UT (US); Karla Gerome, West Valley City, UT (US); Kent Shumway, West Valley City, UT (US)

(73) Assignee: GRACEWOOD MANAGEMENT, INC., West Jordan, UT (US)

( * ) Notice: Subject to any disclaimer, the term of this patent is extended or adjusted under 35 U.S.C. 154(b) by 0 days.

(21) Appl. No.: 18/665,433

(22) Filed: May 15, 2024

(65) Prior Publication Data

US 2024/0295057 A1 Sep. 5, 2024

Related U.S. Application Data

(60) Continuation of application No. 18/162,051, filed on Jan. 31, 2023, now Pat. No. 12,116,709, which is a division of application No. 16/934,670, filed on Jul. 21, 2020, now Pat. No. 11,566,357.

(51) Int. Cl.

| | |
|---|---|
| ***D05B 39/00*** | (2006.01) |
| ***D05B 11/00*** | (2006.01) |
| ***D05B 21/00*** | (2006.01) |

(52) U.S. Cl.

CPC ..... *D05B 39/005* (2013.01); *D05B 11/00* (2013.01); *D05B 21/00* (2013.01)

(58) Field of Classification Search

CPC ..... D05B 39/005; D05B 11/00; D05B 21/00

See application file for complete search history.

(56) References Cited

U.S. PATENT DOCUMENTS

| | | | | |
|---|---|---|---|---|
| 6,990,914 | B2 | 1/2006 | Canan | |
| 11,566,357 | B2 | 1/2023 | Bagley et al. | |
| 2005/0145149 | A1 | 7/2005 | Hooke | |
| 2006/0112866 | A1 | 6/2006 | Pfeifer et al. | |
| 2007/0221108 | A1* | 9/2007 | Koerner | D05B 11/00 112/119 |
| 2009/0064912 | A1 | 3/2009 | Koyake | |
| 2015/0040812 | A1 | 2/2015 | Schwarzberger | |
| 2015/0114272 | A1 | 4/2015 | Bagley | |
| 2020/0248348 | A1* | 8/2020 | Konzak | D05B 3/04 |
| 2023/0167593 | A1 | 6/2023 | Bagley et al. | |

OTHER PUBLICATIONS

Restriction Requirement for U.S. Appl. No. 16/934,670, dated Nov. 17, 2021, 7 pages.

(Continued)

*Primary Examiner* — Nathan E Durham

(74) *Attorney, Agent, or Firm* — Ryan L. Marshall; Jessica Kiser; Barnes & Thornburg LLP

(57) ABSTRACT

A sewing frame unit is provided. The sewing frame unit includes a frame support structure; a frame assembly affixed to the frame support structure; a machine carriage assembly mounted on the frame support structure. The machine carriage assembly provides for lateral and longitudinal movement of the sewing machine. A sensor is mounted on the machine carriage assembly or on the frame assembly for detecting a position of the sewing machine.

8 Claims, 7 Drawing Sheets

(56) References Cited

OTHER PUBLICATIONS

Non-Final Office Action for U.S. Appl. No. 16/934,670, dated Mar. 16, 2022, 9 pages.
Notice of Allowance for U.S. Appl. No. 16/934,670, dated Sep. 30, 2022, 6 pages.
Non-Final Office Action for U.S. Appl. No. 18/162,051, dated May 23, 2023, 8 pages.
Interview Summary for U.S. Appl. No. 18/162,051, dated Aug. 4, 2023, 2 pages.
Final Office Action for U.S. Appl. No. 18/162,051, dated Nov. 16, 2023, 11 pages.
Advisory Action for U.S. Appl. No. 18/162,051, dated Mar. 28, 2024, 3 pages.
Notice of Allowance for U.S. Appl. No. 18/162,051, dated Jun. 17, 2024, 5 pages.

* cited by examiner

SEWING FRAME WITH WORKSPACE EDGE WARNING SYSTEM

CROSS-REFERENCE TO RELATED APPLICATIONS

This application is a continuation of U.S. patent application Ser. No. 18/162,051, filed Jan. 31, 2023, which is a divisional application of U.S. patent application Ser. No. 16/934,670, filed Jul. 21, 2020; the entire contents of these applications are hereby incorporated by reference herein.

BACKGROUND

The present invention is in the field of devices and methods for machine quilting, and, in particular, in the field of quilting frames and other devices and methods for the positioning and detection of the sewing machine's position during sewing.

Devices for machine quilting typically consist of three primary components, a frame, a sewing machine, and a machine carriage having a carriage bottom plate that travels laterally on an x-axis and a carriage top plate that travels longitudinally on a y-axis. Fabric layers, that typically consist of backing fabric, batting, and top fabric, may consist of as few as one layer of fabric or more than three layers, which single fabric layer, or multiple layers collectively, referred to in this application as a "quilt core." The term "fabric layers" when used in this application, shall be defined to include a single layer of fabric. The fabric layers are rolled onto fabric layer rails and fed from the respective fabric layer rails to a take-up rail that passes through the throat of the sewing machine, suspending the fabric layers of the quilt core together to rest on the sewing machine bed. In order for the fabric layers of the quilt core to remain flat and straight, it is necessary for the fabric layer rails and the take-up rail to be longer than the quilt is wide.

For a typical quilting frame, the sewing machine is positioned on and secured to the quilting frame carriage top plate and is guided on the machine carriage to create a desired stitching pattern as the layers of fabric are quilted together. The sewing machine is guided longitudinally and laterally across the available quilting work area, which is determined by the length of the throat of the sewing machine and the width of the quilt fabric itself, the width of the quilt being limited to the width of the quilting frame.

When the fabric in the work area has been sewn, the fabric is rolled forward from the fabric layer rails to the take-up rail so that the completed area is rolled onto the take-up rail that passes through the throat of the sewing machine. This also advances the fabric that has not yet been quilted into the work area and the new strip of un-quilted fabric area may then be sewn. A typical quilting frame requires that the quilt be sewed from front to back, or vice versa, with the fabric progressively being fed onto the take-up rail as each strip of the quilt core is sewed from one side of the quilt core to the other.

An alternative to machine quilting with a traditional frame is to quilt by hand, performing all the stitching without a sewing machine, simply using a needle and thread. Another alternative is to baste the three layers of fabric together using pins or small stitches later to be removed. Once the fabric is basted, the user can quilt the layers together by guiding the fabric through the machine by hand. Hoops may also used to hold small areas of the quilt flat and straight to perform the stitching. Embroidery machines, for example, use a hoop to hold the fabric and then through motor control, move the hoop while the sewing machine stitches to create the desired patterns on the fabric.

Quilting without a frame requires basting, which is time consuming. Hand quilting or quilting by using a hoop also requires basting, and moving the fabric to create the sewing patterns can be cumbersome due to the amount of fabric that has to be manipulated in a large quilt. Machine quilting on a frame is a much more convenient and expeditious way to complete a quilt. Machine quilting on a frame requires a large frame, however, to make large quilts. Many quilters do not have enough space to accommodate the large quilting frame.

SUMMARY

A sewing frame unit is provided. The sewing frame unit includes a frame support structure; a frame assembly affixed to the frame support structure; a machine carriage assembly mounted on the frame support structure, the machine carriage assembly providing for lateral and longitudinal movement of the sewing machine, and a sensor mounted on the machine carriage assembly or on the frame assembly for detecting a position of the sewing machine.

A method for sewing is provided. The method includes detecting a position of a sewing machine mounted on a machine carriage assembly, the machine carriage assembly being supported by a frame support structure; sewing one or more fabric layers in a frame assembly, the frame assembly being supported by and positioned by the frame support structure, wherein the sewing machine can be moved laterally and longitudinally by the user for sewing the pattern segments; and alerting the user when the sewing machine reaches a pre-set position at a periphery of the frame assembly.

In other embodiments, a sewing machine is provided. The sewing machine may include an integral wheeled base and a sensor attached to the integral wheeled base. The sensor may be an encoder that can detect a location of the sewing machine relative to a sewing frame.

DETAILED DESCRIPTION

As used herein "sewing frame" refers to a support structure for stitching fabric or other materials together. An example of a sewing frame is a quilting frame for sewing layers of fabric together.

Figure 1:
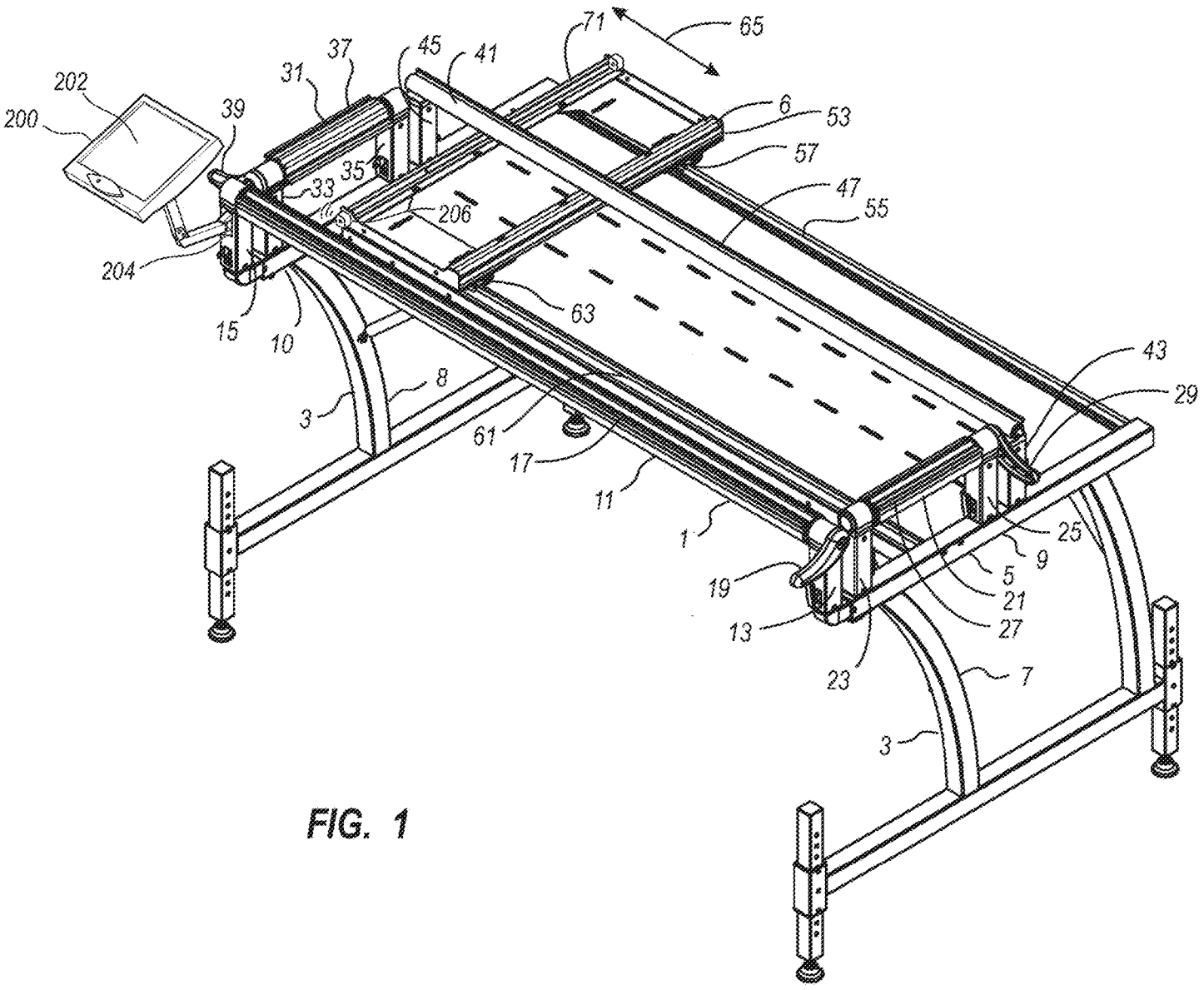
FIG. 1 is a front perspective view of an embodiment of a hoop frame unit, including the frame support structure, hoop frame assembly, and machine carriage assembly.
Figure 2:
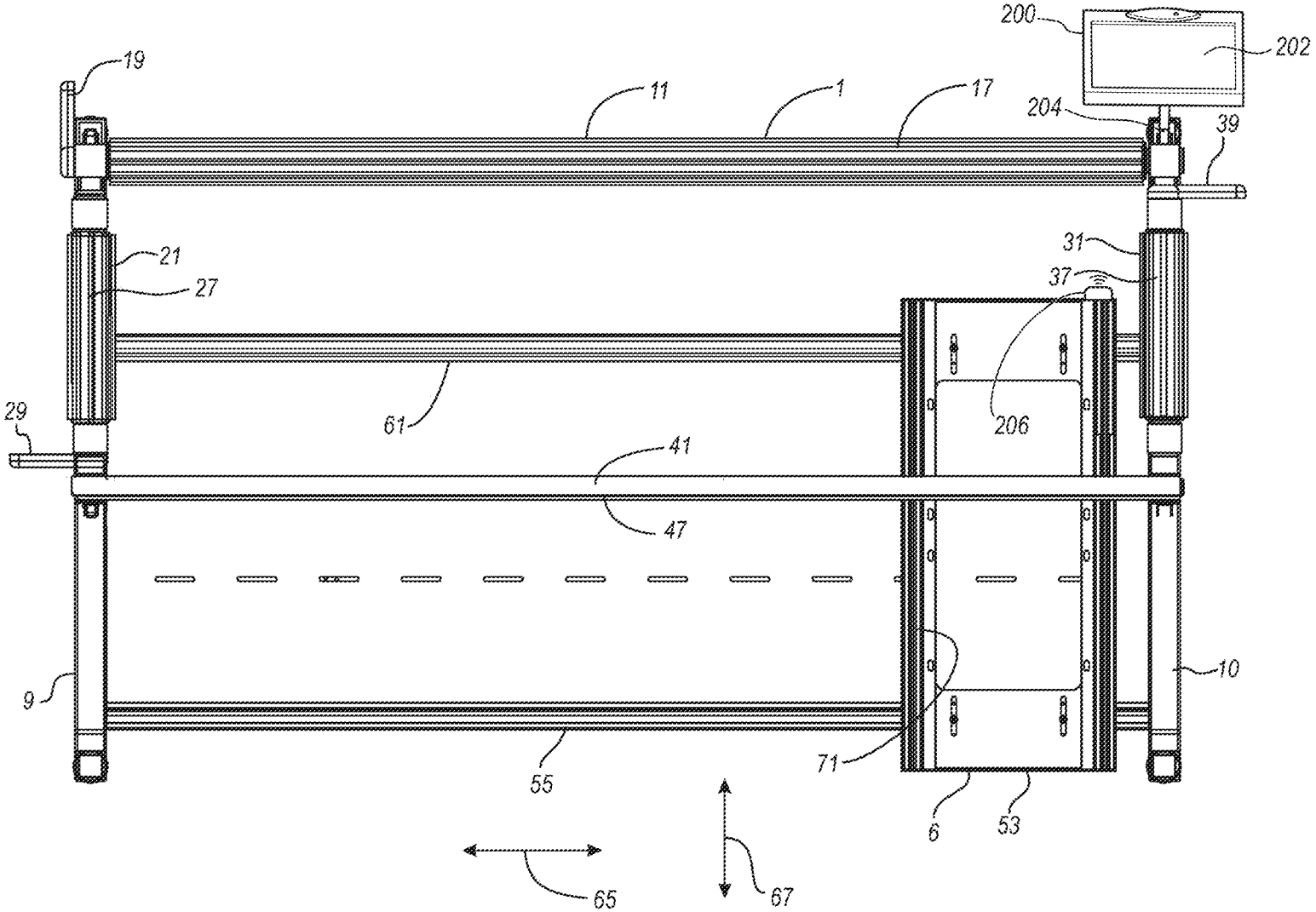
FIG. 2 is a plan view of an embodiment of a hoop frame unit, including the frame support structure, hoop frame assembly, and machine carriage assembly.
Figure 3:
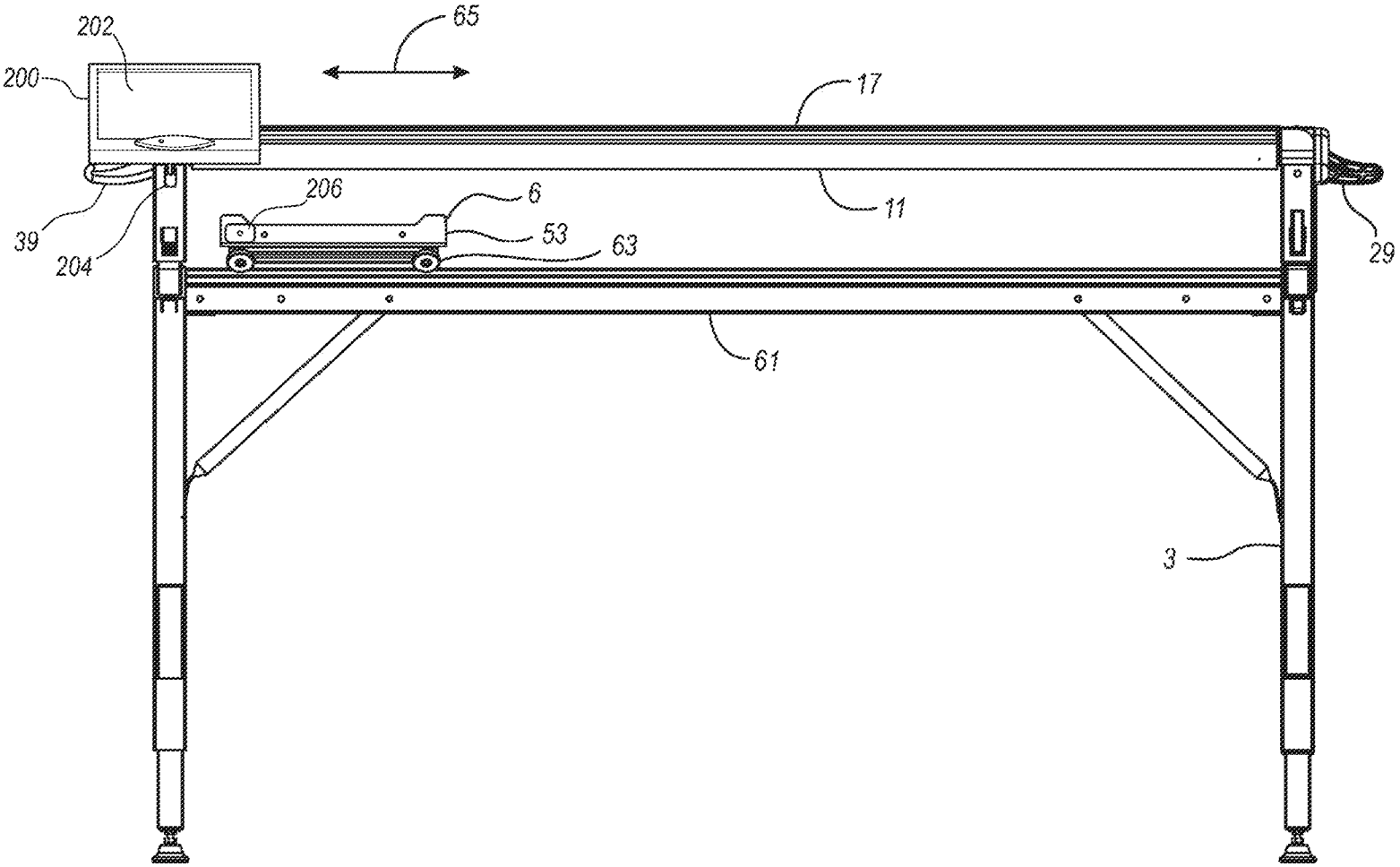
FIG. 3 is a front elevation view of an embodiment of a hoop frame unit, including the frame support structure, hoop frame assembly, and machine carriage assembly.

Referring first to FIG. 1, a front perspective view of an embodiment of a hoop frame unit 1. For the embodiment shown, the hoop frame unit 1 is comprised of a frame support structure 3, a hoop frame assembly 5, and a machine carriage assembly 6. For the embodiment shown, the frame support structure 3 is comprised of a first end support 7 which connects to a first frame end 9 and a second end support 8 which connects to a second frame end 10. Other variations and designs for the frame support structure 3 for supporting, stabilizing and positioning the frame assembly 5, and providing workable access to the frame assembly 5, will be known to persons ordinarily skilled in the art, in view of the disclosures of the specification and drawings presented. Various materials known to persons skilled in the art may be used for the frame support structure 3, as well as the other components of the hoop frame unit 1 and hoop frame assembly 5 of the present invention, which will provide the desired structural strength, durability, functionality, economy and appearance.

The hoop frame assembly 5, for embodiment shown, is comprised of a front fabric retainer 11, a rear fabric retainer 41, a first end retainer 21, and a second end retainer 31. The front fabric retainer 11 is secured to the first frame end member 9 by first front retainer support member 13 and is secured to the second frame end member 10 by a second front retainer support member 15. The first end fabric retainer 21 is affixed to the first frame end member 9 by first end retainer first support member 23 and a first end retainer second support member 25. Likewise the second end fabric retainer 31 is affixed to the second frame end member 10 by second end retainer first support member 33 and a second end retainer second support member 35. The rear fabric retainer 41 is affixed to the first frame end member 9 by first rear retainer support member 43 and is affixed to the second frame end member 10 by the second rear retainer support member 45. Other variations and designs for the hoop frame assembly 5, providing for variations in the connection of the hoop frame assembly components to the frame support structure 3 and for supporting, stabilizing and positioning the frame assembly 5, will be known to persons ordinarily skilled in the art, in view of the disclosures of the specification and drawings presented.

Figure 5:
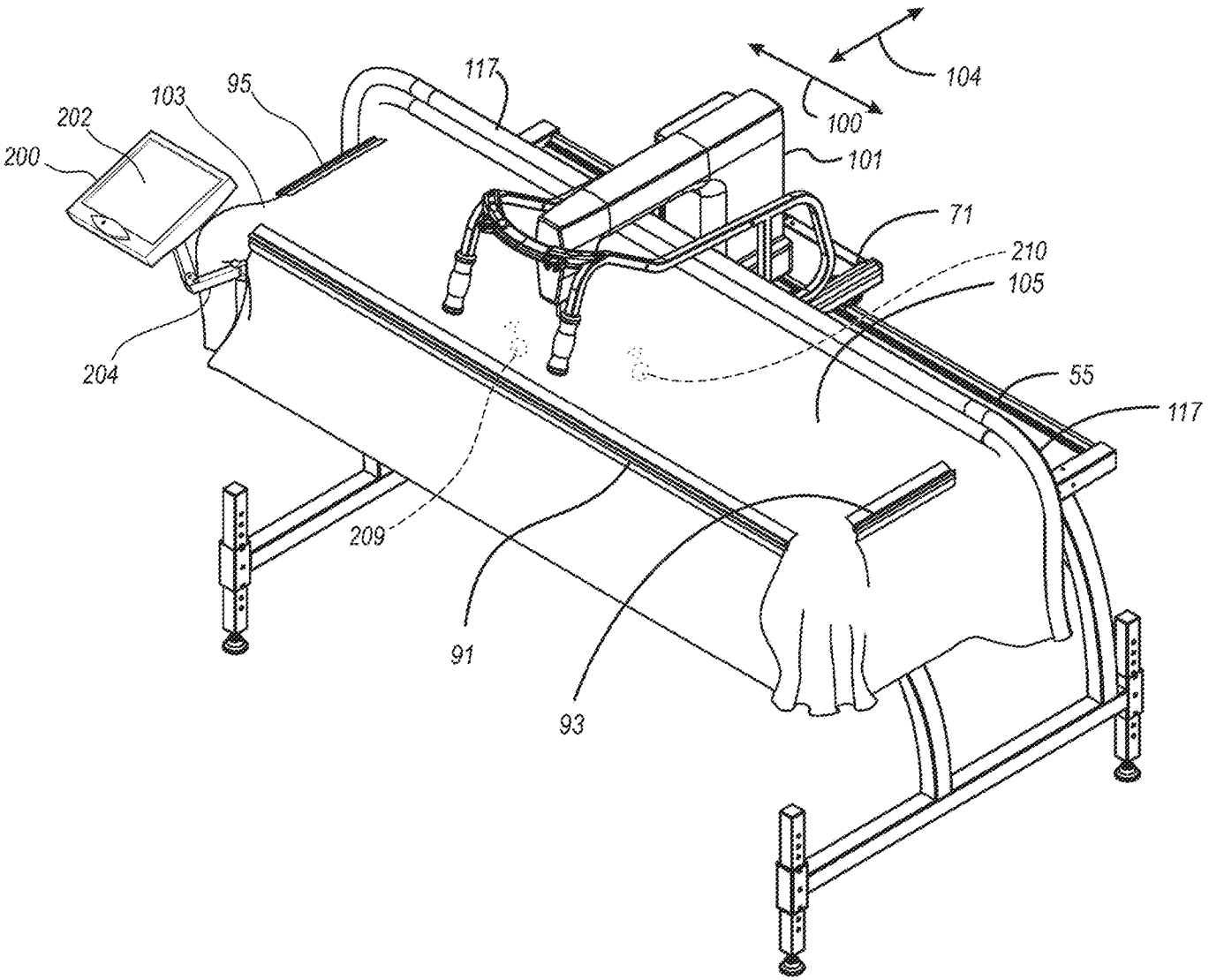
FIG. 5 is a front perspective view of an embodiment of a hoop frame unit, including the frame support structure, hoop frame assembly, and machine carriage assembly, of the present invention with a fabric core in place on the hoop frame assembly and a fabric zone of the fabric core secured by fabric retainers and retainer clips of the hoop frame assembly, and with a sewing machine mounted on the machine carriage assembly.
Figure 6:
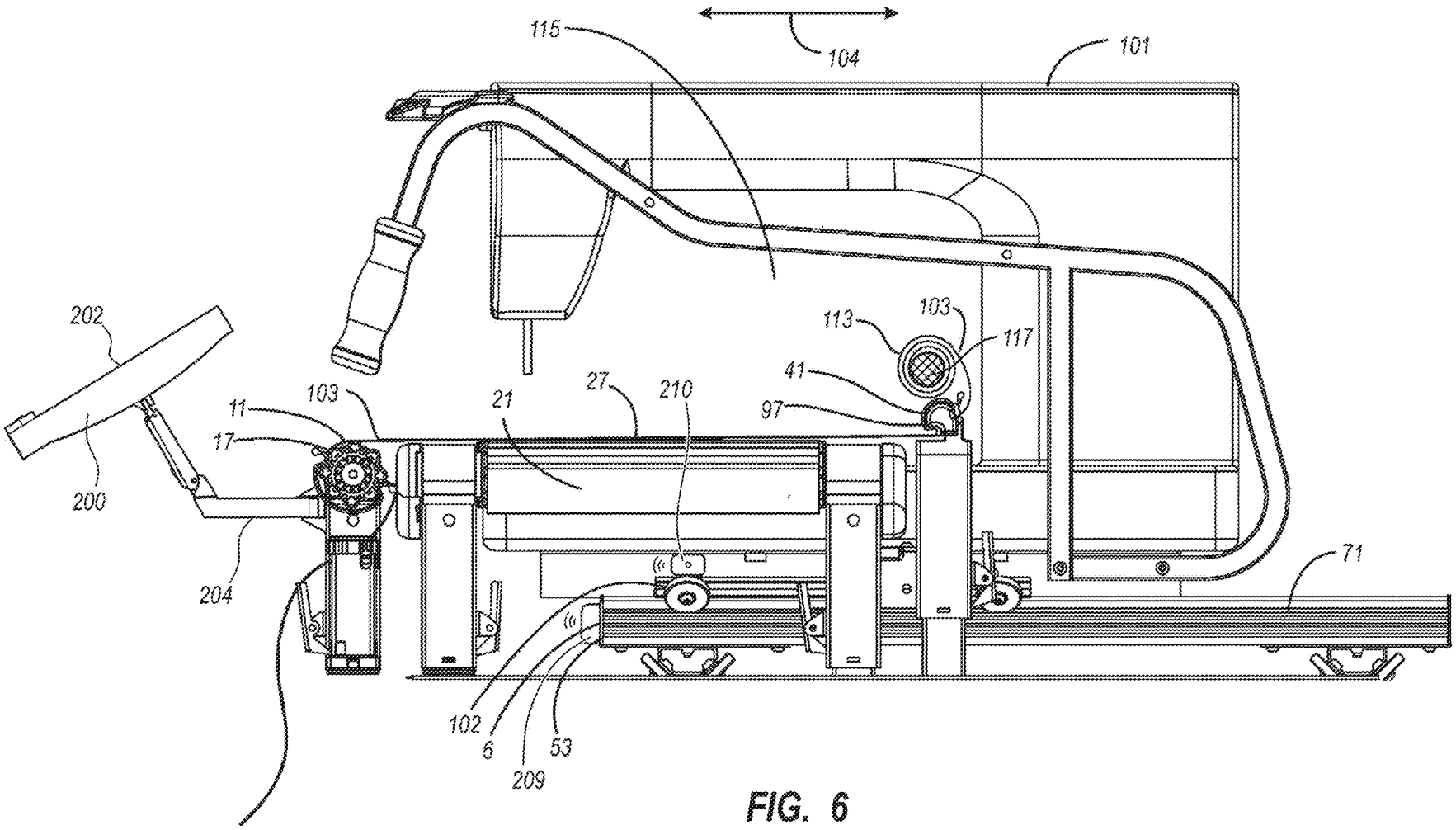
FIG. 6 is an end elevation view of an embodiment of a hoop frame assembly of a hoop frame unit of the present invention with a fabric core in place on the hoop frame assembly and a fabric zone of the fabric core secured by fabric retainers and retainer clips of the hoop frame assembly, and with a sewing machine mounted on the machine carriage assembly.

The machine carriage assembly 6 is supported by a front carriage track 61 and a rear carriage track 55 which are affixed on opposing ends into the first frame end 9 and the second frame end 10. For the embodiment shown, front carriage rollers 63 and rear carriage rollers 57 provide for lateral carriage movement 65, and thus for the machine lateral movement 100 of a sewing machine 101 as shown in FIG. 5. The embodiment of the machine carriage assembly 6 shown in FIG. 1 incorporates a lateral carriage element 53 to which the carriage rollers 63, 57 are affixed, which provide for the machine carriage assembly 6 to accomplish carriage lateral movement 65, and a pair of longitudinal tracks 71, which for the embodiment shown in FIG. 1, provide for a sewing machine 101 with an integral wheeled base 102, as shown in FIG. 6 or a separate wheeled machine base to which a sewing machine may removably mounted, to provide for machine longitudinal movement 104 on the longitudinal tracks 71 on the carriage lateral element 53. Whether the sewing machine 101 itself or the sewing machine 101 mounted on a separate wheeled machine base, is positioned on the longitudinal tracks 71, the sewing machine is free rolling upon the lateral carriage element 53 thereby providing for machine longitudinal movement 104 concurrently with the carriage lateral movement 65 provided by the carriage lateral element 53. The machine carriage assembly 6, therefore provides for machine lateral movement 100 and machine longitudinal movement 104 as shown in FIG. 5 for a sewing machine 101 mounted on the machine carriage assembly 6.

The machine carriage assembly 6 may include a sensor 206 for detecting lateral or longitudinal movement of the machine carriage assembly 6. The sensor 6 may also be mounted on the hoop frame assembly 5. The exact location of the sensor 206 on the hoop frame (FIG. 1-6) or traditional sewing frame (FIG. 7) is not particularly limited as long as the lateral and longitudinal position of the machine carriage assembly 6 can be detected.

The sensor 206 detects a position of the machine carriage assembly 6 within the hoop frame or traditional frame and can transmit wirelessly or through wired connection to a controller 200. In an embodiment, the controller 200 may include a display 202 that a user may interact with to input lateral and longitudinal position information of the machine carriage assembly 6. The controller 200 may be mounted on the frame assembly via an adjustable arm 204. When the machine carriage assembly 6 reaches a pre-set coordinate near the front fabric retainer 11, rear fabric retainer 41, first end retainer 21, or second end retainer 31 the controller 200 will trigger an alert that is an audible buzzer, a vibration, a signaling light, or a combination thereof to alert a user of the position of the machine carriage assembly 6.

In an embodiment, the sensor 206 may be an encoder. The encoder may be an optical encoder, a magnetic encoder, or a rotary encoder. The sewing frame may have a single optical encoder positioned to detect a position of the machine carriage assembly 6. In some embodiments, the sewing frame may include more than one encoder. For example, the encoder is positioned adjacent to the front carriage rollers 63 or the rear carriage rollers 57. In an embodiment, the front carriage rollers 63 or the rear carriage rollers 57 may include a rotary encoder (not visible in FIGs).

Referring to FIGS. 1-6, the front fabric retainer 11 has a front retainer seat 17. The first end retainer 21 has a first end retainer seat 27 and the second end retainer 31 has a second end retainer seat 37. Referring now to FIGS. 5-6, a front retainer clip 91 may be used to secure fabric to the front fabric retainer 11 by mating with the front retainer seat 17 after the fabric core 103 is draped over the front fabric retainer 11. Likewise, a first end retainer clip 93 and a second end retainer clip 95 may be used to mate respectively with the first end retainer seat 27 and the second end retainer seat 37 after the fabric core 103 is draped over the respective end retainers 21, 31 as shown in FIG. 5. In view of the disclosures of this specification and the drawings, alternative embodiments of the retainer seats and retainer clips for securing the fabric zones to the respective fabric retainers, other than that shown in the drawings of the present application, will be known to persons of skill in the art.

Figure 4:
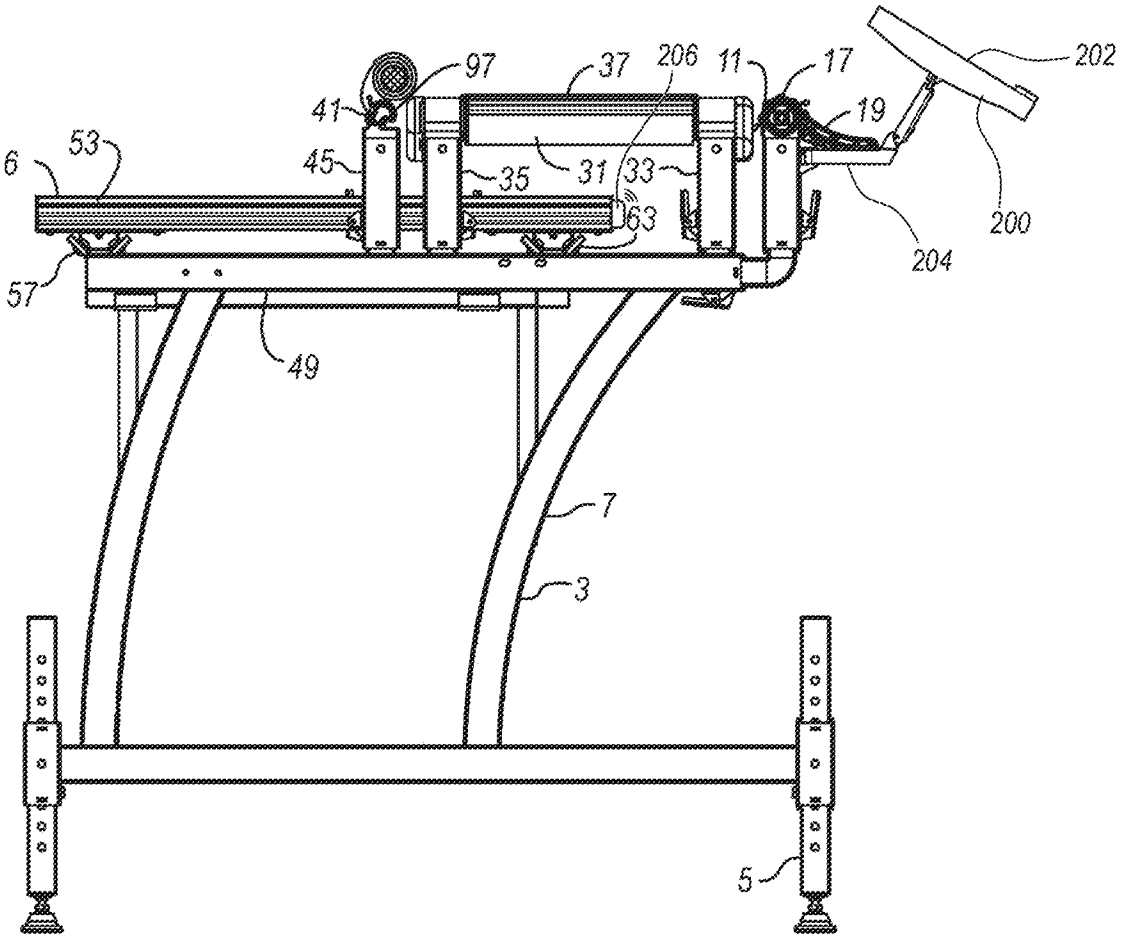
FIG. 4 is an end elevation view of an embodiment of a hoop frame unit, including the frame support structure, hoop frame assembly, and machine carriage assembly.

Referring now to FIG. 4 and FIG. 6, the fabric core 103 may be secured to the rear fabric retainer 41 by draping the fabric core 103 over the rear fabric retainer 41, and securing the fabric core 103 in place by the rear retainer clip 97. The fabric loose end 113 of the fabric core 103 advanced into the machine throat 115 may be rolled onto a flexible take-up spool 117, as shown in FIG. 5 and FIG. 6, to help keep the fabric layers of the fabric loose end 113 from interfering with the sewing of the fabric zone 105. The fabric zone 105 is the portion of the fabric core 103 positioned between the front fabric retainer 11, the first end retainer 21, the second end retainer 31, and the rear fabric retainer 41, after the respective retainer clips 91, 93, 95 and 97, are secured in place for sewing as shown in FIG. 5. A front retainer tightening mechanism 19, first end retainer tightening mechanism 29 and second end retainer tightening mechanism 39 may be used to further tighten the fabric zone 105 as desired for sewing by the sewing machine 101. For preferred embodiments, the front retainer tightening mechanism 19, the first end retainer tightening mechanism 29, and the second end retainer tightening mechanism 39 may have a ratchet drive, and may have optional handles.

When the fabric core 103 is secured and the selected fabric zone 105 is in place as shown in FIG. 5, the sewing machine 101 may be operated by the user to sew the desired sewing pattern in the fabric zone 105. Once the sewing of the fabric zone 105 is completed, the retainer clips, 91, 93, 95 and 97 may be removed from the fabric core 103 and the fabric moved and then re-secured, presenting another selected fabric zone 105 for sewing by the user. The hoop frame unit 1 and the hoop frame assembly 5 of the present invention provide for complete flexibility in the sequencing of the sewing of the respective fabric zones 105. A typical sewing frame requires that the fabric be sewed from front to back, or vice versa, with the fabric progressively being fed onto a take-up rail as each strip of the fabric core is sewed from one side of the fabric core to the other. The hoop frame unit 1 and the hoop frame assembly 5 of the present invention, on the other hand, provide for the fabric core to be re-positioned laterally, longitudinally or diagonally, or to be rotated to any extent desired by the user. When sewing is completed on a fabric zone 105, the user has complete flexibility to re-position the fabric core as desired for the convenience or preference of the user as the user progresses from one fabric zone 105 to another. The user can sequence the sewing of the fabric zones as desired and can overlap respective fabric zones 105 on any side, in any direction, and to any extent desired.

In FIG. 5, an embodiment is shown an embodiment where a first sensor 209 is positioned to detect lateral movement of the machine carriage assembly and a second sensor 210 to track longitudinal movement along the longitudinal tracks 71.

FIG. 6 shows an embodiment where the second sensor 208 is positioned to tract longitudinal movement of the sewing machine.

Figure 7:
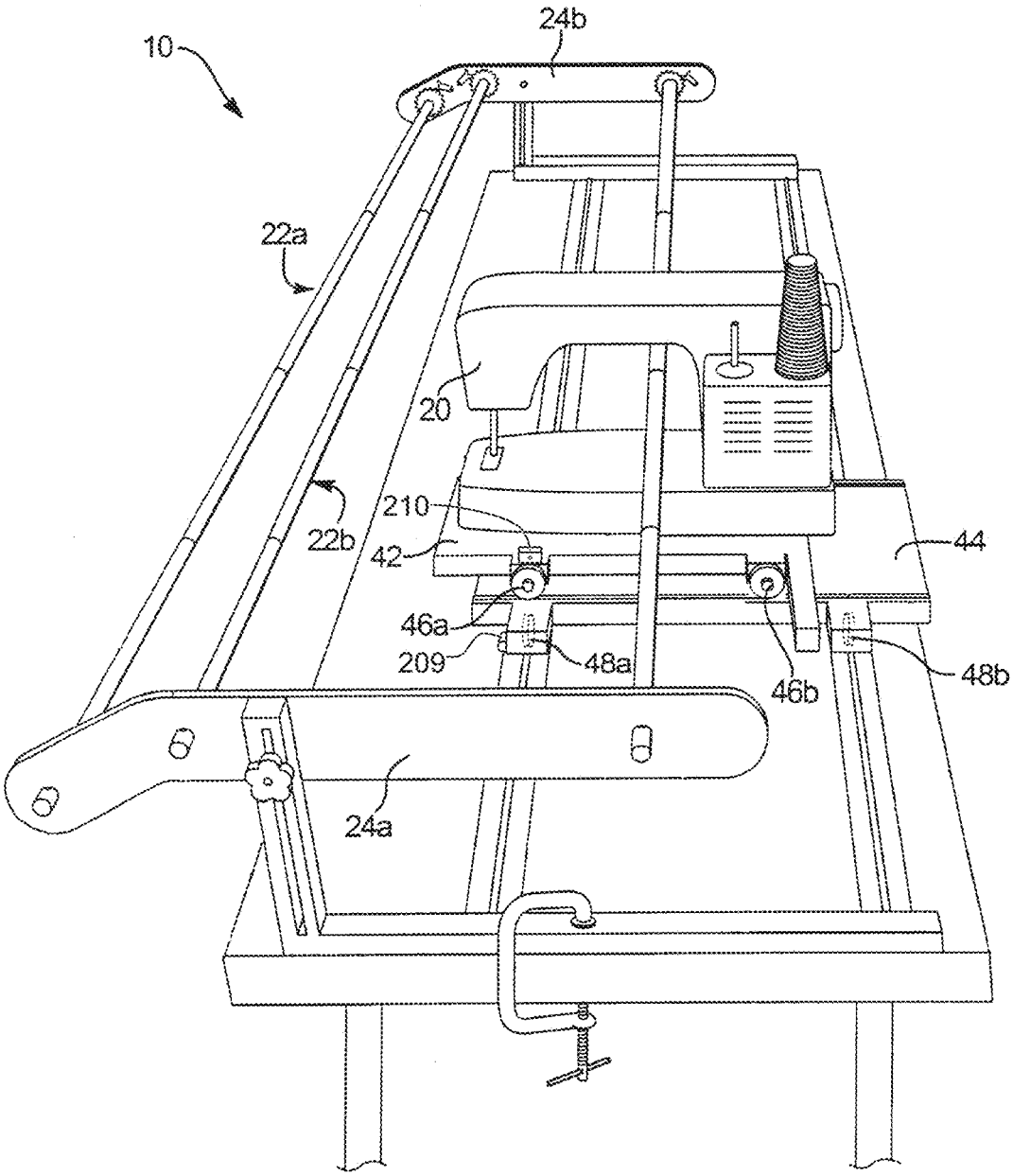
FIG. 7 is a front perspective view of a traditional frame unit with sensors detecting lateral and longitudinal movement of the sewing machine.

Referring to FIG. 7, showing a traditional sewing frame 10. In an embodiment, the first sensor 209 is positioned adjacent to the front carriage rollers 48*a* or the rear carriage rollers 48*b*, and the second sensor 210 is positioned adjacent to a roller attached to a wheeled base 46*a* or 46*b*.

Two or more support members 22*a* and 22*b* are engageably disposed in relation to the opposing end plates 24*a*, 24*b*. The carriage assembly includes an upper carriage component 42 and a corresponding lower carriage component 44. The lower carriage component 44 may be responsible for selectively transporting the sewing machine 20 along the longitudinal dimension of the sewing frame. A plurality of rollers (e.g., wheels) 48*a* and 48*b* may be incorporated into the structural design of the lower carriage component 44 for engaging the track mounted in relation to the working surface, thus providing means for maneuvering the sewing machine 20 mounted in relation to the carriage assembly in the longitudinal direction of the sewing frame. Similarly, a plurality of rollers (e.g., wheels) 46*a* and 46*b* may be incorporated into the structural design of the upper carriage component 42.

A method for sewing is provided. The method includes detecting a position of a sewing machine mounted on a machine carriage assembly, the machine carriage assembly being supported by a frame support structure; sewing one or more fabric layers in a fabric core in a frame assembly, the frame assembly being supported by and positioned by the frame support structure, wherein the sewing machine can be moved laterally and longitudinally by the user for sewing the pattern segments; and alerting the user when the sewing machine reaches a pre-set position at a periphery of the frame assembly.

In some embodiments, the method may further include positioning the sewing machine at the periphery of the frame assembly and storing a location of the sewing machine in a controller.

A sensor mounted on the machine carriage assembly or frame assembly which detects movement of rollers mounted to the machine carriage assembly and generating a signal.

In some embodiments, the method may include sending the signal from the sensor to a controller to determine the position of the machine carriage assembly.

Various means may be employed to alert a user of the position of the machine carriage assembly. Examples include but are not limited to sending a signal from a controller to a device that produces an audible noise, a physical vibration, a signaling light, or a combination thereof. Multiple, simultaneous alerts may be generated to alert the user. For example, when the machine carriage assembly approaches a pre-set position at a periphery of the fabric core, an audible noise may be produced along with a physical vibration felt through the handles used to move the machine carriage assembly.

In other aspects, a sewing machine is provided. The sewing machine may include an integral wheeled base and a sensor attached to the integral wheeled base. The sensor may be an encoder that can detect a location of the sewing machine relative to a sewing frame.

As used herein, the term "controller" refers to a manual operator or an electronic device having components, such as a processor, memory device, digital storage medium, a communication interface including communication circuitry operable to support communications across any number of communication protocols and/or networks, a user interface (e.g., a graphical user interface that may include cathode ray tube, liquid crystal display, plasma display, touch screen, or other monitor), and/or other components.

The controller is preferably operable for integration with one or more application-specific integrated circuits, programs, computer-executable instructions or algorithms, one or more hard-wired devices, wireless devices, and/or one or more mechanical devices. Moreover, the controller is operable to integrate the feedback, feed-forward, and/or predictive loop(s) of the invention. Some or all of the controller system functions may be at a central location, such as a network server, for communication over a local area network, wide area network, wireless network, internet connection, microwave link, infrared link, wired network (e.g., Ethernet) and the like. In addition, other components, such as a signal conditioner or system monitor, may be included to facilitate signal transmission and signal-processing algorithms.

In view of the disclosures of this specification and the drawings, other embodiments and other variations and modifications of the embodiments described above will be obvious to a person skilled in the art. Therefore, the foregoing is intended to be merely illustrative of the invention and the invention is limited only by the following claims and the doctrine of equivalents.

What is claimed is:

1. A method for sewing, comprising:

detecting a position of a sewing machine mounted on a machine carriage assembly, the machine carriage assembly being supported by a frame support structure;

sewing one or more fabric layers in a frame assembly, the frame assembly being supported by and positioned by the frame support structure, wherein the sewing machine can be moved laterally and longitudinally by a user for sewing pattern segments; and alerting the user when the sewing machine reaches a pre-set position at a periphery of the frame assembly, wherein the frame assembly comprises a front fabric retainer that extends laterally, a rear fabric retainer that extends laterally, a first end retainer that extends longitudinally between the front and rear fabric retainers, and a second end retainer that extends longitudinally between the front and rear fabric retainers, wherein the front fabric retainer, the rear fabric retainer, the first end retainer, and the second end retainer are each fixed in place on the frame support structure, and wherein the front fabric retainer, the rear fabric retainer, the first end retainer, and the second end retainer define the periphery of the frame assembly.

2. The method of claim 1, further comprising positioning the sewing machine at the periphery of the frame assembly and storing a location of the sewing machine as the pre-set position in a controller.

3. The method of claim 1, wherein the alerting the user comprises sending a signal from a controller to a device that produces an audible noise, a physical vibration, a signaling light, or a combination thereof to alert a user of the position of the machine carriage assembly.

4. The method of claim 1, wherein the detecting comprises sensing movement of rollers mounted to the machine carriage assembly and generating a signal.

5. The method of claim 4, further comprising sending the signal to a controller to determine the position of the machine carriage assembly.

6. The method of claim 1, wherein the machine carriage assembly or the frame assembly comprises a sensor that detects the position of the sewing machine.

7. The method of claim 6, wherein the sensor is an encoder, and the encoder is positioned adjacent to front carriage rollers or rear carriage rollers.

8. The method of claim 1, wherein the machine carriage assembly further comprises a front carriage track, a rear carriage track, a lateral carriage element, a pair of longitudinal tracks on the lateral carriage element, and front and rear carriage rollers mounted to the lateral carriage element.

* * * * *